United States Patent [19]

Harper, Jr. et al.

[11] 3,975,152

[45] Aug. 17, 1976

[54] SIMULTANEOUS DYEING AND CROSSLINKING OF CELLULOSIC FABRICS

[75] Inventors: Robert J. Harper, Jr., Metairie; Joseph S. Bruno, Chalmette; Eugene J. Blanchard, New Orleans; Gloria A. Gautreaux, Metairie, all of La.

[73] Assignee: The United States of America as represented by the Secretary of Agriculture, Washington, D.C.

[22] Filed: Jan. 23, 1975

[21] Appl. No.: 543,616

Related U.S. Application Data

[62] Division of Ser. No. 395,097, Sept. 7, 1973, Pat. No. 3,871,817.

[52] U.S. Cl. ..... 8/17; 8/30

[51] Int. Cl.[2] ..... D06P 5/00

[58] Field of Search ..... 8/17, 65, 66, 185, 30

[56] References Cited

UNITED STATES PATENTS

| | | | |
|---|---|---|---|
| 3,044,843 | 7/1962 | Tullio | 8/17 |
| 3,402,988 | 9/1968 | Reeves | 8/185 |
| 3,788,804 | 1/1974 | Harper et al | 8/17 |

FOREIGN PATENTS OR APPLICATIONS

| | | | |
|---|---|---|---|
| 948,782 | 2/1964 | United Kingdom | 8/65 |

OTHER PUBLICATIONS

Millson et al., Amer. Dyestuff Rep., June 28, 1948, pp. 423–432.

*Primary Examiner*—Donald Levy
*Attorney, Agent, or Firm*—M. Howard Silverstein; Salvador J. Cangemi; David G. McConnell

[57] ABSTRACT

This invention relates to fabric treatments by which cotton and cellulosic blended fabrics can be provided with wrinkle resistance (smooth dry performance) and color at the same time. In particular, it provides a means by which cellulosic fabrics can be dyed with basic dyestuffs. In addition to a conventional means by which the entire fabric can be dyed with a basic dye, variations are achieved in which one side of the fabric is dyed one color and the other side of the fabric is dyed a second color. The color on the reverse side can be provided by means of either basic dyes or regular cotton dyes. The technique has also been extended for the printing of fabrics.

3 Claims, No Drawings

SIMULTANEOUS DYEING AND CROSSLINKING OF CELLULOSIC FABRICS

This is a division of application Ser. No. 395,097 filed Sept. 7, 1973, now U.S. Pat. No. 3,871,817.

FIELD TO WHICH THE INVENTION RELATES

This invention relates to treatments which impart wrinkle resistance to cellulosic textile materials. In particular it relates to providing a method by which cotton fabrics may be finished so that they will be wrinkle resistant and will be dyed with basic dyes at the same time.

In essence, this invention relates to treating cellulosic fabrics with a finishing formulation that contains a crosslinking agent, an acid catalyst, and a basic dye. The fabric is then cured and washed. The principal advantages of this procedure is that basic dyes are characterized by having a high color value and brightness of shade. Cotton fibers are not normally dyeable with basic dyes and this procedure provides a way by which basic dyes can be put on cellulosic fabrics with good dye uptake and color retention characteristics. The simultaneous dyeing and crosslinking, of course, has certain economic advantages.

With respect to the prior art, basic dyes show little affinity and durability for cotton and other cellulosic fabrics. In order to enable cotton and cellulosic fabrics to be dyed with basic dyes, a chemical modification such as carboxymethylation or other type reaction is necessary to make the fabric dyeable with basic dyes. This chemical modification does not represent a practical method for several reasons. First, the chemical modifications are usually expensive in themselves. Second, Hydroxyl groups are utilized which are normally reactive in crosslinking the cotton for wash-wear finishes. Thus, it is frequently difficult to achieve good smooth dry performance when the chemical modification takes place prior to the application of crosslinking agent. Finally, because chemical modifications are usually base catalyzed while crosslinking is acid catalyzed, control of pH in the various operations becomes an additional expense. For the above reasons, the use of such systems to permit the dyeing of cotton with basic dyes has not gained commercial acceptance. Because of the high color values and bright shades, it would be useful to dye cotton with basic dyes. At the same time, it is necessary to be mindful of the necessity to produce cotton fabrics with good smooth drying characteristics. The objective of this invention is to dye cotton fabrics with basic dyes and to crosslink cotton fabric at the same time. The advantage would be to achieve color and smooth dry performance in a single operation.

There are three components in the finish. The first component is the crosslinking agent. The crosslinking agent serves several functions. First, it imparts smooth drying characteristics to the fabric. Second, it acts as a trapping agent closing up and reducing the subsequent accessibility of the fabric thus improving dye retention. Third, in cases in which hydroxy acid are employed in the finish, it chemically reacts with the cotton (cellulose) and the hydroxy group of the hydroxy acid, thus binding this acidic agent to the cotton in a durable fashion. Because of the affinity of the basic dye for the acidic function, this, in turn, increases the retention of the basic dye on the fabric as well as producing better overall efficiency of dye uptake.

While any of the usual nitrogenous methylated crosslinking agents will perform satisfactorily in this process, most of the work in this invention was performed with dimethylol dihydroxyethyleneurea(DMDHEU). This agent was selected because it is currently the most widely used agent in commercial finishing. Because of its tetrafunctional reactivity, reaction with the hydroxyl group of a hydroxy acid does not impair its potential ability to crosslink the cellulosic molecule.

In the operation of this invention, any suitable acid catalyst seems to be effective in producing a crosslinked fabric that is dyed with a basic dye at the same time. All that is required is that it possess sufficient acidity to catalyze the crosslinking of cellulose. However, the most effective catalysts in terms of efficiency of dye uptake and retention of dye to repeated laundering are those which incorporate a hydroxy acid in the finish. The purpose of the hydroxy acid is to carry the basic dye along with it while it serves as a reactive acid catalyst. Its durability arises because both the hydroxy group of the acid and the hydroxy groups of cellulose are reactive with the N-methylol groups of the crosslinking agent. Examples of such acids are citric, malic, lactic, glycolic, tartaric and gluconic acids. Although high concentrations of these acids are suitable by themselves as acid catalysts, particularly effective are the so-called mixed acid systems, which employ a combination of metal salt such as magnesium chloride or zinc nitrate with one of the aforementioned hydroxy acids. In addition to the normal stoichiometric ratio of 1:1, a catalyst mixture with a somewhat higher ratio of hydroxy acid to metal salt catalyst also performs well. The advantage of a mixed catalyst system is that it is a strong catalyst in which the hydroxy acid portion likewise possesses reactivity with the crosslinking agent.

Other systems that can be used are the usual metal salt catalysts such as magnesium chloride or zinc nitrate. In this case, the formulation consists of crosslinking agent, metal salt catalyst and basic dye. After treatment with this combination, the result is the same as analogous to the previous case in that a crosslinked fabric that is dyed with a basic dye is produced.

The third component in the finishing bath is the basic dye. Basic dyes are, of course, well known and practically any dye indicated as a basic dye by the Color Index system should be suitable. Representative samples of basic dyes used in this work include the following:

Basic Red 14
Basic Red 22
Basic Red 23
Basic Red 25
Basic Orange 21
Basic Yellow 25
Basic Blue 41

The standard method used in this invention is finishing process in which the fabric is padded with a formulation containing a basic dye, crosslinking agent and acid catalyst, then dried and cured to produce a durable press fabric which is uniformly dyed one color with the given basic dye. However, several variations have been developed to produce fabrics which are not a single color. Examples of such variations will now be described.

For styling and use purposes, reversible fabrics are desirable which are one color on one side and a second color on the other side. These may be obtained by use of this invention in the following manner.

An untreated cotton or other cellulosic fabric is coated with a formulation containing crosslinking agent, such as DMDHEU, an acid catalyst such as a magnesium chloride-citric acid mixed catalyst, a basic dye such as Basic Yellow 25 and a thickener such as hydroxyethyl cellulose. The formulation is mixed to such a viscosity so that its action is limited to the side of the fabric to which it has been applied. That is, it coats one side of the fabric only. The fabric is then dried. The reverse side of the fabric is then coated with a different coating formulation, which consists of a crosslinking agent an acid catalyst, a thickener and a different basic dye such as Basic Red 25. The fabric is then dried and cured. The result is a crosslinked fabric which is yellow on one side and red on the other side. This represents one way of producing a fabric which is one color on one side and a different color on the reverse side.

Another way has been devised for production of bicolored fabrics. In this method after the initial coating, as before with crosslinking agent, acid catalyst, basic dye, and thickener, the fabric is dried and cured. Then it is dyed using a normal cotton dye, such as a reactive dye or a direct dye using standard dye procedures. When this is done, the untreated side of the fabric is dyed. However, because it is crosslinked, the coated side of the fabric is not dyed by the reactive or direct dye. By proper selection of dye combinations, fabrics can be obtained which are one color on one side and a different color on the other side. If additional smooth dry performance is desired, the side of the fabric dyed with the cotton dye can be coated with a formulation containing crosslinking agent, acid catalyst and thickener or the entire fabric can be padded with a formulation containing crosslinking agent and acid catalyst, and the fabric dried and cured.

The coating formulation can also be applied to the fabric in more limited areas of fabric. For example, well known printing techniques can be used for application. If this is done, stripes or other designs are produced on the fabric after the usual drying and curing.

Another variation of the basic method was developed for printing purposes. In this case, the fabric was padded with a crosslinking formulation consisting of crosslinking agent such as DMDHEU and an acid catalyst such as a mixed catalyst. The fabric was dried. Then designs and prints were applied to the fabric. Each formulation used for each color in the print contained a basic dye and a thickener. The amount of thickener used can either be such that it restricts the dye to the top of the fabric or else it may be such that it allows the dye to go through the fabric but limits the area on the fabric to which the dye spreads. In one case, three different colored formulations were used to apply to the fabric. Each formulation contained either a red, a yellow, or a blue basic dye. After the prints and designs had been applied to the fabric, the fabric was dried again and cured. There was produced a crosslinked durable press fabric with bright red, yellow, and blue designs in which the colors were durable to repeated laundering.

In another variation of this standard method, the same printing procedure is employed except for the fact that the dye formulation contains added crosslinking resin and acid catalyst in addition to the basic dye and thickener. Otherwise the procedure is the same as in the previous case. Either procedure gives equally satisfactory results.

Another modification is useful in producing fabrics which have the appearance of a brushed denim. This consists of producing a fabric that is dyed on one side only. Two procedures were developed to accomplish this. The first procedure is the initial step of the process described earlier for producing bicolored fabrics. That is, the face of the fabric was coated with a formulation consisting of thickener, crosslinking agent, basic dye and acid catalyst. The fabric was coated, dried and cured. The result is a fabric which is dyed on one side but not on the other. An additional treatment either by padding or backcoating with formulations containing crosslinking agent but no dyestuff can be employed to further increase the smooth dry capabilities of the fabric.

A second process can be used to produce a fabric which is crosslinked uniformly throughout. In this case, the fabric is padded with a crosslinking formulation containing a crosslinking agent such as DMDHEU and an acid catalyst such as a mixed catalyst. Then, the face of the fabric is coated with a formulation containing basic dye and thickener or basic dye, thickener, acid catalyst and crosslinking agent. The fabric is now dried and cured to produce a fabric that is dyed on one side only with a basic dye.

Although these processes have been designed previously for cotton and cellulosic fabrics, they can be used on polyester-cotton and other blended fabrics provided there is sufficient cellulosic component to provide good reaction with the crosslinking agent system. These processes are particularly effective on blended fabrics in which the noncellulosic component is dyeable with a basic dye. An example of such a blend is cotton and a basically dyeable polyester, such as, Eastman's type 511 polyester. The latter is a standard polyester fiber which has been modified so that it will accept basic dyes. A fiber blend such as this is advantageous because it provides a fabric which by means of this process can be crosslinked and dyed simultaneously using a single dye system. Normally cotton-polyester blends need to be dyed with a cotton dye and a polyester dye and a system which permits the use of a single dye would be economically advantageous.

REAGENTS

In cases in which the fabric is padded with the crosslinking and dyeing mixture, the essential ingredients are crossling agent, the acid catalyst and basic dye. In the case in which the crosslinking agent is dimethylol dihydroxyethyleneurea, a concentration of from 1 to 15% can be used in the pad bath. However, for most fabrics, a concentration of from 6 to 10% is sufficient to give an adequate level of smooth-dry performance.

While the concentrations have been given for dimethylol dihydroxyethyleneurea as the crosslinking agent, similar amounts of other agents such as dimethylolethyleneurea, dimethylol propyleneurea or dimethylol ethylcarbamate may be used.

With respect to the acid catalyst, the concentration will depend somewhat on the type of catalyst employed. If zinc nitrate hexahydrate is the catalyst, from 0.1 to 1.5% may be used with the higher amounts appropriate for the high level treatments with crosslinking agent. With the optimum amount of crosslinking agent 6 to 10%, 0.4 to 0.7% of zinc nitrate hexahydrate is appropriate. Similarly with magnesium chloride hexahydrate, the catalyst concentration can be used from a 1 to 5% range with about 2 to 3% being sufficient for the optimum amount of crosslinking agent. If the hydroxy acids are used as catalysts, concentration ranges from 2 to 5% of the hydroxy acid may be used with from 3 to 4% normally being the amount used with the optimum amount (6 to 10%) of DMDHEU. Examples of hydroxy acids used in this way are citric acid, glycolic acid, tartaric acid, lactic acid, malic acid and mandelic acid. If mixed acid systems are employed (combinations of hydroxyacids and metal salt catalysts), mixed acid concentrations ranging from 0.5 to 2.5% are effective. With the suggested amount of DMDHEU (6–10%), a mixed acid concentration of approximately 0.8 to 1.5% is appropriate. Any of the previously mentioned metal salt catalysts and hydroxy acids can be used as catalysts. Other effective catalysts, which can also be used, are equal amounts of 1% mixed catalysts and 1% hydroxy acid (overall ratio is thus 1 part metal salt to 3 parts hydroxy acid). While the above represent a variety of acid catalysts, it should be understood that the method is likewise applicable to the many other acid catalysts used in crosslinking finishes.

Of the catalyst systems employed in this work, the mixed catalysts and modified mixed catalysts give colors which are the brightest and most durable to laundering.

The third component in the finish is the basic dye. While any concentration of dye up to 3 to 4% can be used, quite satisfactory and bright shades can be achieved by the use of from 0.5 to 1.0% dye in the finish. Any of the standard Basic Dyes as indicated in the Color Index can be used in the finishing formulation.

With respect to the coating formulations the components are crosslinking aget, acid catalyst, basic dye, and thickener. The crosslinking agent, DMDHEU, is used at a concentration of from 6 to 15% in the coating formulation with about from 10 to 12.5% giving the best results. With this latter concentration, 1% zinc nitrate hexahydrate or 1% mixed catalyst (citric acid-magnesium chloride hexahydrate) is sufficient catalyst to produce adequate crosslinking of the dimethylol dihydroxyethyleneurea or other crosslinking agent. If other catalysts are used, the amounts are scaled proportionately to the concentration of crosslinking agent using the same ratios as indicated with the previously mentioned padding solutions. The other components of the coating formulation are the dye and the thickener. Sufficient color can be produced using 1% basic dye in the coating formulation but additional or lower amounts can be used depending upon the depth of shade desired. The other component of the coating formulation is the thickener. For example hydroxyethylcellulose can be used in amounts from 0.6 to 1.0% and satisfactory results were obtained using 0.8% hydroxyethylcellulose in the coating formulation.

In printing operations, the same formulations as used in coating were employed. However, these formulations were adjusted so that the amount of thickener was reduced to 0.4 to 0.5% when greater penetration of the dye into the fabric was desired. Other printing formulations used consisted of 1.0% dye and thickener (hydroxyethylcellulose — 0.4 to 1.0%). This type formulation was used on fabrics in which the fabrics had been previously presensitized with dimethylol dihydroxyethyleneurea.

In summary, the essential treatment of this method is the application of crosslinking agent, acid catalyst and basic dye to fabric, followed by drying and curing to produce a crosslinked fabric that is dyed with a basic dye. Although the examples are given using dimethylol dihydroxyethyleneurea as the crosslinking agent, the method is effective with other agents such as dimethylolethyleneurea, dimethylolpropyleneurea, methylol melamine or dimethylol ethylcarbamate. Drying and curing conditions are those which suffice to make the crosslinking agent react.

EXAMPLE 1

Cotton print cloth was padded with a solution containing 9.0 parts dimethylol dihydroxyethyleneurea, 0.7 part zinc nitrate hexahydrate, 0.5 part of Basic Red 14, and 89.8 parts of water. The fabric was dried for 7 minutes at 60° C and cured for 15 minutes at 135° C. The fabric was then washed and tumbled dry. The resulting fabric was smooth with a good tumble dry rating (4), high wrinkle recovery and was a bright pink color. A sample of this fabric was laundered 10 times and it retained its bright coloration. This sample indicates that this method provides a way to produce a durable press fabric and to dye cotton fabrics with a basic dye at the same time. The bright color of the fabric produced by this procedure using a small amount of dye illustrates the advantage of being able to dye cotton fabrics with a basic dye. A parallel procedure was employed replacing the red dye in the padding formulation with Basic Yellow 25 or Basic Blue 41 to produce durable press fabrics dyed yellow or blue, thus indicating that the method can be used with any number of basic dyes.

EXAMPLE 2

Cotton print cloth was padded to an uptake of about 100% with a solution containing 9.0 parts dimethylol dihydroxyethyleneurea, 4.0 parts of magnesium chloride hexahydrate, 0.5 part of a basic dye (Basic Yellow 25) and 86.5 parts of water. The fabric was dried for 7 minutes at 60° C and cured for 15 minutes at 135° C. The fabric was then washed and tumbled dry. The bright yellow color, which was durable to laundering and the good durable press rating of the fabric, attests to the effectiveness of the method in producing durable press performance and good dyeing with a basic dye in a single treatment using magnesium chloride as the catalyst. Analogous results were experienced when Basic Red 14 was used as the basic dye except that the finished fabric was a bright pink.

EXAMPLE 3

The same procedure using the various finishing formulations described in examples 1 and 2 was applied to a 50-50 polyester-cotton fabric. The resulting fabrics had good durable press performance and had the appropriate colors of the basic dye used in the formulation. The same techniques were applied to 100% polyester fabric but dye uptake was poor and not durable to laundering. This indicates the need for some cellulosic component in the fabric to make the finish an effective treatment.

EXAMPLE 4

Cotton print cloth was padded as before with a formulation consisting of 9.0 parts dimethylol dihydroxyethyleneurea, 1.0 part mixed catalyst (consisting of 0.5 part citric acid and 0.5 part magnesium chloride hexahydrate), and 0.5 part of a basic dye (Basic Red 14)

and 89.5 parts water. The fabric was dried for 7 minutes at 60° C and cured for 5 minutes at 120° C. The fabric was then laundered and tumbled dry. The resultant fabric was smooth drying with a durable press rating of 4.4 and a wrinkle recovery angle (warp plus filling) of 293°, and had the bright deep color of the basic dye (pink) thus indicating the effectiveness of the method. This same treatment was repeated in which the basic dye used was Basic Yellow 25. Similar results were observed except that the finished fabric was yellow.

Analogous results were experienced when other mixed catalyst combinations were used in finishing. The mixed catalyst combinations employed consisted of 0.5 part magnesium chloride hexalydrate and 0.5 part of the hydroxy acid. The hydroxy acids used were glycolic, mandelic, tartaric and gluconic. In each case, one part of these mixed acid catalysts was substituted for the one part of citric acid-magnesium chloride catalyst used in the initial formulation described in this example. In each case, the finished fabric was smooth after laundering and was the color of the appropriate basic dye used in the finish (Basic Red 14 or Basic Yellow 25).

EXAMPLE 5

Two padding solutions were prepared consisting of 9.0 parts dimethyl dihydroxyethyleneurea, 1.0 part mixed catalyst (0.5 part magnesium chloride hexahydrate and 0.5 part citric acid), 0.5 part basic dye and 89.5 parts water. In one formulation the basic dye was Basic Yellow 25, while in the other, it was Basic Red 14. A cotton knit fabric and a 50–50 blended woven fabric were padded with these formulations, dried for 7 minutes at 60° C and cured for 5 minutes at 120° C. The fabrics were then laundered and tumbled dry. In each case, the fabric had a good durable press rating and had taken on the color of the appropriate basic dye used in the finishing formulation. These results illustrate that the method is effective both on woven blended fabrics and on knitted cellulosic fabrics.

EXAMPLE 6

A cotton print cloth was padded with a finishing formulation consisting of 9.0 parts dimethylol dihydroxyethyleneurea, 4.0 parts citric acid, 0.5 part Basic Yellow 25, and 86.5 parts water. The fabric was dried for 7 minutes at 60° C and cured for 5 minutes at 160° C. Similar experiments were performed in which the 4.0 parts of citric acid were replaced by 4.0 parts of other hydroxy acids in the preceding finishing formulation. The hydroxy acids used were 4.0 parts mandelic acid, 4.0 parts glycolic acid or 4.0 parts tartaric acid. The fabrics from these experiments were laundered and tumbled dry. In each case, the fabrics had good durable press ratings (approximately 4.0) and were dyed yellow.

The finishes using citric acid and other hydroxy acids were applied to a 50-50 cotton-polyester blended fabric and similar results were observed.

EXAMPLE 7

Cotton print cloth was padded with a formulation consisting of 9.0 parts dimethylol dihydroxyethyleneurea, 1.5 parts citric acid, 0.5 part magnesium chloride, 0.5 part Basic Yellow 25 and 88.5 parts water. The fabric was then dried for 7 minutes at 60° C and cured for 5 minutes at 120° C. Other fabric was finished similarly except that the 1.5 parts of citric acid was replaced by either 1.5 parts of glycolic acid, tartaric acid, or mandelic acid. The fabrics were laundered and tumbled dry. In each case, the fabrics had a good durable press rating and the color of the basic dye. In the case in which the citric acid-magnesium choride was the catalyst, the fabric had a durable press rating of 4.6 plus wrinkle recovery angle of 301° (warp and filling).

The formulation in this example using citric acid and magnesium chloride and other mixed catalyst combinations were also applied to a 50-50 polyester-cotton blended fabric with similar good results.

EXAMPLE 8

Two samples of a cotton twill fabric were face coated with a formulation containing 11.3 parts dimethylol dihydroxyethyleneurea, 1.0 part zinc nitrate hexahydrate, 0.8 part hydroxyethylcellulose, 1.0 part Basic Yellow 11 and 85.9 parts water. The fabrics were dried with a hot air gun. Then, one sample was backcoated with a formulation equivalent to the above except that the 1.0 part of Basic Yellow 11 was replaced by Basic Blue 41 in the formulation. Similarly, the second fabric was backcoated with a second formulation in which the 1.0 part of Basic Yellow 11 was replaced with 1.0 part of Basic Red 14. The fabrics were then dried with a hot air gun and cured for 15 minutes at 130° C. In a similar fashion, an additional cotton fabric was facecoated with the formulation containing Basic Blue 41 and backcoated with the formulation containing Basic Red 14. This sample was then cured for 15 minutes at 130° C. The fabrics were then laundered and tumbled dry. The result was a durable press fabric which was dyed one color on one side and a second color on the other side. That is, the fabrics were red on one side, and blue or yellow on the other. Or, in turn, blue on one side and yellow on the other. This process provides a way in which durable press fabrics may be produced which are dyed one color with a basic dye on one side and a second color with a different basic dye on the other side.

The same procedures were repeated as described above except that instead of the 1.0 part zinc nitrate hexahydrate, each one of the following catalyst systems were employed with proper adjustment for the amount of water in the finish and for the curing time appropriate to each fabric.

| Amount of Catalyst | Catalyst | Cure Time/Temp. |
|---|---|---|
| 4.0 parts | magnesium chloride hexahydrate | 5 min. at 160° C. |
| 1.0 part | mixed catalyst consisting of 0.5 part magnesium chloride hexahydrate and 0.5 part of one of the following: citric acid, glycolic acid, tartaric acid, mandelic acid | 5 min. at 120° C. |
| 2.0 parts | mixed catalyst consisting of 0.5 part magnesium chloride hexahydrate and 1.5 parts of one of the following: citric acid, glycolic acid, tartaric acid, mandelic acid | 5 min. at 120° C. |
| 4.0 parts | of one of the following hydroxy acids: citric acid, glycolic acid | 5 min. at 160° C. |

-continued

| Amount of Catalyst | Catalyst | Cure Time/Temp. |
|---|---|---|
| | tartaric acid<br>mandelic acid | |

In each case there was produced a durable press fabric, which was one color on one side and a second color on the other side.

EXAMPLE 9

Several samples of a cotton twill were facecoated with the formulations described in example 8. Thus, the coating formulation contained 11.3 parts dimethylol dihydroxyethyleneurea, 1.0 part zinc nitrate hexahydrate, 0.8 part of hydroxy ethyl cellulose, 1.0 part basic dye and 85.9 parts water. The basic dyes employed were Basic Yellow 11, Basic Red 14, and Basic Blue 41. The fabrics so treated were dried with a hot air gun and cured for 15 minutes at 130°C. The fabrics were then washed. These treatments produced fabrics which were crosslinked and dyed on one side only. These fabrics have useful styling properties in themselves and are unique in that the crosslinking and dyeing have been done on the same side of the fabric.

However, the fabrics can be further modified to produce bicolored fabrics. In this case samples of the fabrics which have received the above facecoat treatments were dyed with reactive cotton dyes using standard procedures for application of cotton dyes which are well known to those skilled in the art. The cotton dyes used for these treatments were Reactive Blue 4, Reactive Red 1, and Reactive Yellow 22. The procedure employed for each 3.3 parts of fabric was as follows:

Two parts reactive dye were added to 98 parts of water. Then, 1.3 parts sodium sulfate were added to dye and water. The fabric was added and stirred for 15 minutes. The fabric was removed and 1 part sodium carborate was added to the dye bath. The fabric was reinserted in the bath and stirred for 15 minutes. The dye bath was decanted, the fabric was rinsed in cold tap water, then stirred for five minutes in a hot water bath containing wetting agent (0.1% Triton X-100) for 5 minutes.

The result from these experiments was a series of fabrics which were blue, yellow or red on one side due to the dyeing with the basic dye, and which were blue, red or yellow (but different color from the first side) on the other side due to the dyeing with the reactive dye. This then represents a process for producing bicolored fabrics in which the face of the fabrics was one color from the basic dye and the reverse side of the fabric was a second color from the reactive dye.

EXAMPLE 10

The durable press performance of the samples in example 9 can be improved by either of two procedures. In one case, the fabric (from example 9) was padded with a formulation containing 5.0 parts dimethylol dihydroxyethyleneurea and 0.4 part zinc nitrate hexahydrate and 94.6 parts water. The fabric was dried for 7 minutes at 60° C and cured for 15 minutes at 130° C. In the other procedure, the fabric (from example 9) was coated (on the side dyed with the reactive dye) with a formulation containing 9.0 parts dimethylol dihydroxyethyleneurea, 0.7 part zinc nitrate hexahydrate, 0.8 part hydroxyethyl cellulose and 89.5 parts water. The fabric was dried with a hot air gun and cured for 15 minutes at 130° C.

EXAMPLE 11

An analogous series of samples to the samples listed in example 9 was prepared except that the 1.0 part zinc nitrate hexahydrate was replaced in the coating formulation with 1.0 part mixed catalyst (comprised of 0.5 part magnesium chloride hexahydrate and 0.5 part citric acid. The procedure was the same except that the cure after the cotting step was 5 minutes at 120° C. The results were the same as exhibited in example 9 (that is, either bicolored fabrics were produced or fabrics dyed on a single side), except that dye uptake was better and durability to laundering was improved.

Other variations of this same procedure were employed except that the 0.5 part citric acid was replaced by one of the following comparable catalysts: 0.5 part glycolic acid or 0.5 part mandelic acid or 0.5 part tartaric acid. The same procedure was also employed in which the catalyst consisted of 0.5 part magnesium chloride hexahydrate and 1.5 parts of one of the following: citric, mandelic, glycolic, or tartaric acid. In each case by this process, there was produced a fabric with good smooth dry performance and which was dyed on one side with a basic dye.

In another variation of the same procedure, the coating formulation consisted of 11.3 parts dimethylol dihydroxyethyleneurea, 0.8 part hydroxyethyl cellulose, 1.0 part basic dye, 82.1 parts water, and 4.0 parts of one of the following acids:

glycolic acid
citric acid
tartaric acid
mandelic acid

In each case, the procedure was the same as the earlier example except that the cure time was 5 minutes at 160° C.

Similar results were also observed when the acid catalyst was 4% magnesium chloride hexahydrate with these coating formulations.

EXAMPLE 12

The finishing treatments described in example 10 were applied to the fabrics produced in example 11 to produce bicolored durable press cotton fabrics.

EXAMPLE 13

The procedures described in examples 9, 10, 11, and 12 were applied to a 50–50 polyester-cotton fabric to produce bicolored durable press polyester-cotton fabrics.

EXAMPLE 14

The coating formulations from example 9 (red, blue, and yellow colors) were printed onto cotton fabric in various designs, stripes, prints, letters and words. The fabric was then dried for 7 minutes at 60° C and cured for 15 minutes at 130° C. The fabric was then washed and dried. The result was a cotton fabric with various designs, stripes, prints, letters and words that were durable to laundering. This experiment indicates that the procedure described in this process is useful in printing operations to produce brightly colored prints using basic dyes on cotton fabrics. Similar results were experienced when the same treatments were used on 50–50 polyester-cotton blended fabric. In addition to the formulations described in example 9, formulations of reduced viscosity were also used. In this case, the formulation was adjusted by using lower amounts of hydroxyethylcellulose (0.0 to 0.6 part.) and comparably increased amounts of water in the formulation. By this technique the color penetrates through the fabric.

EXAMPLE 15

Samples of the fabrics from example 14 were dyed with Reactive Orange 4 using the procedure for dyeing fabric with reactive dyes described in example 9. The areas where the basic dye and crosslinking agent were applied were undyed by the reactive dye but dyed with basic dye, whereas, the rest of the fabrics were dyed with the reactive dye. The fabrics were then padded with a crosslinking formulation containing 9 parts dimethylol dihydroxyethyleneurea and 0.5 part zinc nitrate hexahydrate and 90.5 parts water. They were then dried for 7 minutes at 60° C and cured for 15 minutes at 130° C. The fabrics were laundered and tumbled dry. The result was durable press fabrics in which the designs were in the color of the basic dyes while the background was the color of the reactive dyes. Analogous results were obtained using a 50–50 cotton-polyester blended fabric.

EXAMPLE 16

The coating formulations from example 11 (red, blue, and yellow colors) were painted or printed onto cotton twill fabric in the form of various designs, stripes, prints, letters, or words. Several different colors were used on each fabric. The fabrics were dried for 7 minutes at 60° C and cured for 5 minutes at 120° C. The fabrics were then washed and dried. The result was a brightly printed cotton fabric (prints in basic dyes). The prints were durable to laundering. A similar process was also applied to a 50/50 polyester-cotton fabric to produce similarly brightly colored printed fabrics. This process provides a way by which basic dyes, which have high color values and high efficiency can be used to print cotton or cellulosic blended fabrics.

EXAMPLE 17

The coating formulations from example 11 (red, blue, and yellow colors) were printed onto cotton fabrics in various designs, stripes, prints, letters and words. The fabrics were dried for 7 minutes at 60° C and cured for 5 minutes at 120° C. The fabrics were then afterwashed and dried. Then, the fabrics were dyed with Reactive Orange 4 using the procedure described in example 9. The fabrics were then padded with a formulation containing 9.0 parts dimethylol dihydroxyethyleneurea, 0.5 part zinc nitrate hexahydrate, and 90.5 parts water. The fabrics were then dried for 7 minutes at 60° C and cured for 15 minutes at 130° C. The fabrics were then laundered and tumbled dry. Other fabrics were also treated in the same way with the same dye types but with different color combinations. This resulted in a fabric with prints done in basic dyes while the background was dyed with the cotton dye. This represents a further extension of this process for the multicolored dyeing of cotton fabrics.

Other samples were also used in which the thickener content and hence the viscosity of the formulation was reduced. In this case, the formulation was adjusted by using lower amounts of hydroxyethylcellulose (0.0 to 0.6 part) with comparably increased amounts of water in the formulation. By this technique, controlled penetration to various depths and even through the fabric, was achieved.

EXAMPLE 18

In this case both cotton twill fabric and a 50–50 polyester-cotton fabric, were padded with a formulation containing 9.0 parts dimethylol dihydroxyethyleneurea, 1.0 part mixed catalyst (0.5 part citric acid and 0.5 part magnesium chloride hexahydrate), and 90 parts water. The fabric was then dried for 7 minutes at 60° C. Then, basic dyes were printed on the fabrics in designs, stripes, words, and other artistic designs. The formulation prepared for printing contained 1.0 part basic dye, 0.8 part hydroxyethylcellulose (thickener) and 98.2 parts water. The basic dyes used in this formulation were Basic Yellow 11, Basic Red 14, and Basic Blue 41. After the red, blue, and yellow designs were printed on the fabric, the fabric was dried for 7 minutes at 60° C and cured for 5 minutes at 120° C. The fabric was then washed to give a durable press fabric with brightly colored designs.

With a different sample of untreated cotton, the same procedure was employed by padding the fabric with the formulation containing DMDHEU, acid catalyst, and water. The fabric was dried. Then, basic dyes were printed on the fabric. In this case, the printing formulation contained 1.0 part basic dye, 5.0 parts DMDHEU, 0.5 part hydroxyethylcellulose, 0.5 part mixed catalyst, and 93.0 parts water. The basic dyes used in this case were Basic Yellow 25, Basic Red 14, and Basic Blue 41. The fabrics were dried and cured. Again durable press fabrics were produced with brightly colored designs on them.

The same procedures were employed on 50–50 polyester-cotton fabrics with analogous results to produce blended fabrics with brightly colored designs.

In addition to the catalyst containing 0.5 part magnesium chloride hexahydrate and 0.5 part citric acid, other mixed catalyst combinations were employed in the initial padding solutions. Examples of such combinations were 0.5 part magnesium chloride hexahydrate and 0.5 part glycolic, mandelic or tartaric acid and 0.5 part magnesium chloride hexahydrate and 1.5 parts of citric, glycolic, mandelic or tartaric acid. The rest of the experiment was the same as described previously and by this means crosslinked fabrics were produced with brightly colored printed patterns.

EXAMPLE 19

The same procedure was employed as in example 18 except that the 1.0 part mixed catalyst in the padding formulation was replaced with 0.5 part zinc nitrate hexahydrate and 0.5 part water. Similar results were observed with these fabrics as in the previous case, namely, that durable press cotton and blended fabrics were produced with brightly colored designs on them.

Other examples of changes of acid catalyst in the initial padding solution were also made. Examples of the acid catalysts used and time of final cure can be seen in the accompanying table.

| Acid Catalyst | Cure Time |
|---|---|
| 0.5 part zinc nitrate hexahydrate | 5 min. at 160° C. |
| 4.0 parts magnesium chloride hexahydrate | 5 min. at 160° C. |
| 4.0 parts citric acid | 5 min. at 160° C. |
| 4.0 parts tartaric acid | 5 min. at 160° C. |
| 4.0 parts glycolic acid | 5 min. at 160° C. |

-continued

| Acid Catalyst | Cure Time |
|---|---|
| 4.0 parts mandelic acid | 5 min. at 160° C. |

After printing with various formulations as given in example 18, and curing, there was produced in each case a smooth drying fabric with brightly colored printed patterns.

We claim:

1. A process for printing cellulosic containing fabric with basic dyes, said process comprising:

a. padding the fabric with an aqueous solution containing dimethylol dihydroxyethyleneurea, and about 0.5 to 4.0 weight percent of an acid catalyst selected from the group consisting of:
zinc nitrate hexahydrate,
magnesium chloride hexahydrate,
citric acid,
tartaric acid,
glycolic acid,
mandelic acid, and
a mixture of magnesium chloride hexahydrate with any of citric, tartaric, glycolic or mandelic acid in 1:1 or 1:3 ratios, b. drying the fabric from (a) at a temperature from 30° to 90° C for a period of 2 to 30 minutes, c. printing the fabric from (b) with an aqueous formulation comprising:
0.5 to 3.0 weight percent basic dye, and
0.0 to 1.0 weight percent hydroxyethylcellulose, d. drying the printed fabric from (c) at a temperature from 30° to 90° C for a period of 2 to 30 minutes, and e. curing the fabric from (d) at a temperature of 120° to 160° C for a period from about 5 to 15 minutes.

2. The process of claim 1 wherein the formulation of step (c) further comprises 1.0 to 8.0 weight percent dimethylol dihydroxyethyleneurea.

3. The process of claim 2 wherein the formulation of step (c) further comprises up to 1.0 weight percent of a mixed catalyst containing magnesium chloride hexahydrate and citric acid.

* * * * *